United States Patent [19]

Jones

[11] Patent Number: 4,595,542

[45] Date of Patent: Jun. 17, 1986

[54] AIR ATOMIZING THROTTLE BODY

[75] Inventor: James H. Jones, Farmington Hills, Mich.

[73] Assignee: Ford Motor Company, Dearborn, Mich.

[21] Appl. No.: 689,106

[22] Filed: Jan. 7, 1985

[51] Int. Cl.[4] ..... F02M 69/04

[52] U.S. Cl. ..... 261/53; 261/44 D; 261/DIG. 82

[58] Field of Search ..... 261/53, 44 D, 62, DIG. 82

[56] References Cited

U.S. PATENT DOCUMENTS

| | | | |
|---|---|---|---|
| 1,669,070 | 5/1928 | Swartz et al. . | |
| 1,927,090 | 9/1933 | Hess | 261/44 D |
| 1,934,240 | 11/1933 | Scott | 261/44 D |
| 3,223,394 | 12/1965 | Walsh | 261/79 R |
| 3,943,904 | 3/1976 | Byrne . | |
| 4,066,721 | 1/1978 | Graham | 261/62 |
| 4,105,163 | 8/1978 | Davis, Jr. . | |
| 4,154,781 | 5/1979 | Mineck . | |
| 4,212,277 | 7/1980 | Melotti | 261/DIG. 82 |
| 4,250,856 | 2/1981 | Abbey | 261/DIG. 82 |
| 4,341,193 | 7/1982 | Bowler | 261/DIG. 82 |
| 4,347,823 | 9/1982 | Kessler et al. . | |
| 4,419,972 | 12/1983 | Hattori et al. | 261/44 D |
| 4,434,110 | 2/1984 | Highfield | 261/44 D |

FOREIGN PATENT DOCUMENTS

| | | | |
|---|---|---|---|
| 2034404 | 6/1980 | United Kingdom | 261/DIG. 82 |

*Primary Examiner*—Tim Miles

*Attorney, Agent, or Firm*—Robert E. McCollum; Clifford L. Sadler

[57] ABSTRACT

A fuel atomizing throttle body is formed to receive a centrally located fuel injector near the inlet to the throttle body induction passage, the throttle body having an axially moveable throttling sleeve in the induction passage that cooperates with a fuel atomizer adjacent the injector for variably metering the primary flow of air into the engine while simultaneously increasing the velocity of the air to impact the metered fuel essentially at right angles to the fuel to atomize the same prior to entry of the mixture into the engine, the fuel atomizer having swirl passages further mixing the fuel with air upon discharge from the injector and providing a secondary minimum air flow volume to sustain engine operation during idle speed conditions when the primary path is closed.

1 Claim, 3 Drawing Figures

AIR ATOMIZING THROTTLE BODY

This invention relates in general to a fuel injection system of the single point, throttle body type, and more particularly, to one that includes an axially slideable throttle valve for variably controlling the volume of air flowing into the induction passage.

More specifically, the invention relates to an air throttle body having a fuel injector concentrically mounted at the entrance to the air/fuel induction passage for the spray of fuel in a conical pattern thereinto and includes a throttling type sleeve valve axially moveable by rack and pinion gear means to meter the flow of air into the engine in a manner to also atomize the fuel.

Throttle bodies with fuel injectors and/or longitudinally moveable throttling valves are known. For example, U.S. Pat. No. 1,669,070, Swartz, et al, and U.S. Pat. No. 4,154,781, Mineck, both show a throttle valve movable longitudinally, the valve in Swartz being moved by rack and pinion gear means. U.S. Pat. No. 3,943,904, Byrne, shows a central fuel injection (CFI) system with, however, conventional rotary type throttle valves. U.S. Pat. No. 4,105,163, Davis, et al, shows a fuel nozzle with sleeves concentrically mounted to provide swirling air paths. U.S. Pat. No. 4,347,823, Kessler, et al, shows a cone-shaped fixed distribution skirt dividing the air flow into two paths for flow past conventional rotatable throttle valves.

None of the above prior art references disclose an axially moveable throttling sleeve valve that cooperates with a centrally located fuel injector to provide a number of different volume air paths for combination with the fuel injected, in the manner to be described.

A primary object of the invention, therefore, is to provide a fuel injection type air throttling body supporting a single point type centrally located fuel injector surrounded by an air throttling sleeve valve that is axially moveable by rack and pinion gear means to provide a plurality of air paths impacting and atomizing the fuel.

Other objects, features and advantages of the invention will become more apparent upon reference to the succeeding detailed description thereof, and to the drawings illustrated a preferred embodiment thereof: wherein, FIG. 1 is a schematic cross-sectional view of a throttle body embodying the invention;

Figure 1:
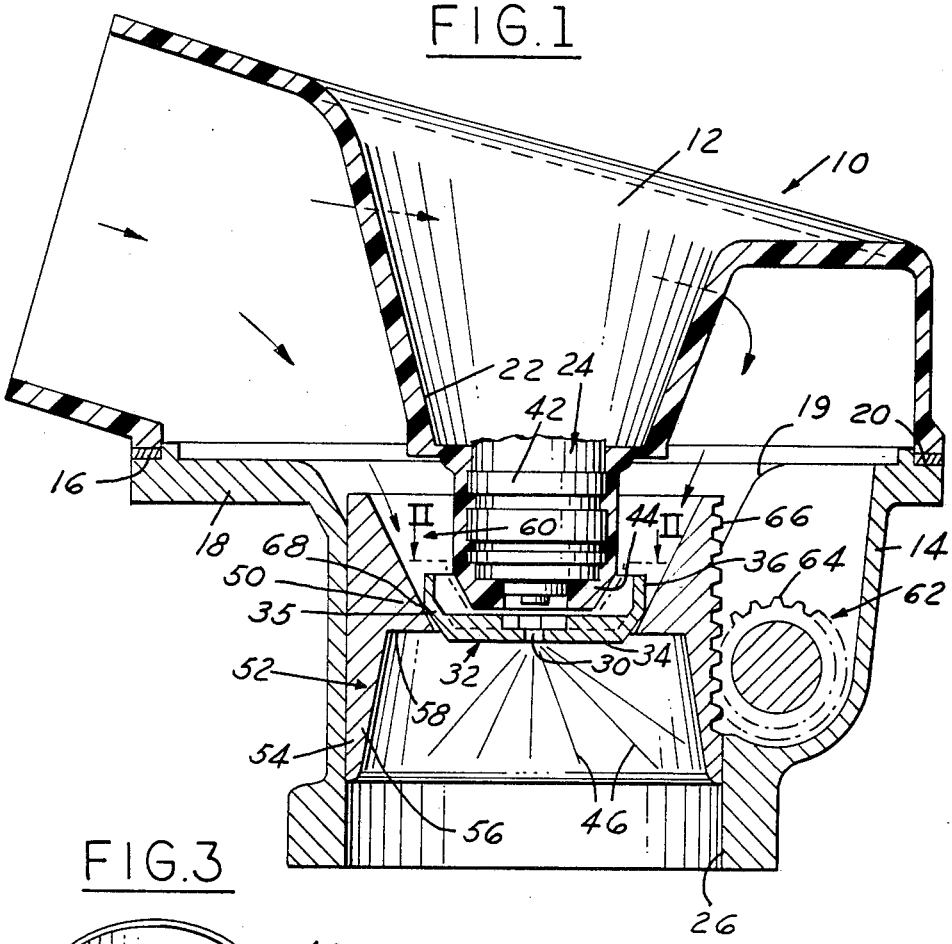

As shown, the throttle body of the invention includes a two-piece housing 10 consisting of an upper air horn cover portion 12 bolted to a lower combination main fuel charging and throttle body portion 14. Upper portion 12 is adapted to be connected at its leftward end to the clean air side of a conventional automotive type air cleaner, not shown, for receiving air therefrom at essentially atmospheric or ambient pressure level.

The air horn 12 is essentially L-shaped in cross-section with in this case a square bottom flange 16. The flange mates with a similarly shaped flange 18 formed on the main fuel charging portion 14, an annular gasket 20 being sandwiched between the two. The inlet end of the air horn is shown with an oval shape for compactness and to provide a low profile. It is formed with a well-like housing at 22 for the mounting therein of a fuel injector 24 of a known type.

The housing 12 is shaped internally to flow air around the injector housing to cool the fuel in and around the injector while also maintaining an annular flow of air into an induction passage 26 formed in lower body portion 14. Flange 18 is shown flared at 19 to minimize restriction of flow of air from the inlet into the induction passage.

Figure 3:
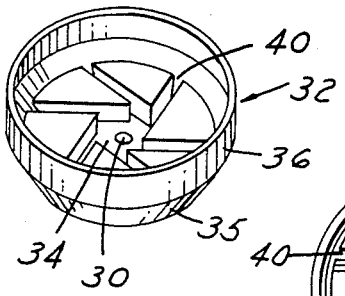
FIG. 3 is a perspective view of that shown in FIG. 2.
Figure 2:
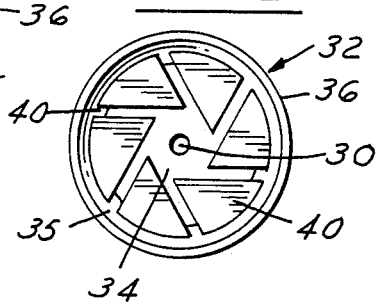
FIG. 2 is a plan view of a detail shown in FIG. 1.

The fuel injector 24 is concentrically mounted above the inlet to induction passage 26 and is adapted to cooperate with an air flow fuel atomizing cup 32. The cup is supported from the air horn 12 by means not shown. As best seen in FIGS. 2 and 3, cup 32 has a flat base plate-like portion 34, an angled side wall 35, and a vertical annular wall portion 36. The essentially horizontal base plate 34 includes a central hole 30 through which the injector fuel and air are discharged in a manner to be described. The wall portion 36 includes a plurality of air swirl inducing vortex-like slots 40 that open tangentially into a central swirl chamber 34. The chamber is formed beneath the fuel injector to provide a vortex-like swirling action to the air to mix with the fuel discharged from the injector. The slots and the central hole 30 define a metered minimum volume air flow path 44 from the air horn to the induction passage.

As indicated by lines 46, fuel is sprayed from the injector in a conical pattern. The swirl inducing ports 40 not only induce a swirl to the air flowing therethrough, but impact on the fuel spray essentially at right angles thereto prior to passing through the hole 38. This provides good atomization of the fuel so that large fuel droplets do not pass down into the engine proper or unduly wet the sidewalls.

The angled sidewall portion 35 of the atomizing cup 32 cooperates with the conical ramp-like projection 50 of a drop sleeve type throttling valve 52. The latter is moveable axially to variably meter the main flow of air into the throttle bore. More particularly, throttling valve 52 consists of a sleeve having first and second radially inwardly projecting annular ramp portions 50 and 56 defining a step 58 between the two. The ramp 50 converges in a downward direction axially toward the intake manifold of the engine to progressively decrease in area as indicated. This converging or tapering portion 50 cooperates with the angled wall portions 35 and 36 of the cup shaped atomizing member 32 to together define an annular convergent/divergent (C-D) flow path 60 between the two for the main flow of air from the air horn section into the lower portion of the throttle body, as indicated by the arrows.

The flow area 60 is variable in area by means of an operator movable rack and pinion gear drive mechanism 62. The latter consists of a pinion gear 64 meshing with a rack 66 fixed to the sleeve 52. Rotation of the pinion gear 64 in either direction, by means not shown, will slide the sleeve valve 52 downwardly or upwardly, as the case may be, to increase or decrease the throat area 68; i.e., the minimum cross-sectional area of the C-D nozzle flow path).

Such a C-D nozzle increases the velocity of the air flowing therethrough by increasing the pressure drop across the throat area as the valve moves upwardly, causing the air to be discharged to impact at high velocity with the air/fuel spray essentially at right angles to the direction of the fuel spray indicated at 46.

The drop sleeve or throttling valve 52 is provided with the second annular ramp portion 56 that projects radially inwardly towards the center of the throttle bore and tapers axially progressively in a downward direction radially outwardly as shown to provide a gradual pressure recovery and velocity reducing diffuserlike section. The step 58 between the two ramp portions provides an abrupt enlargement of the area below the C-D nozzle discharge portion providing a sharp pressure differential with rapid pressure recovery and velocity decrease.

The operation is believed to be clear from the above description, and, therefore, will not be given in detail. Briefly, however, during engine idle speed operation, the fuel injector 24, which is electromagnetically energized to provide a predetermined fuel flow schedule, will deliver a pulsed flow of fuel out through hole 30 in the conical spray pattern indicated. Simultaneously, the manifold vacuum of the engine will induce a flow of air from the air horn portion 12 towards the C-D flow path and towards the injector 24, as indicated by the arrows. At idle speed operation, the gear drive 62 will locate the drop sleeve or throttling valve 52 in the position indicated closing the C-D path. A measured portion of the intake air sufficient to support idle speed operation will be metered through the slots 40 swirled in the center chamber and turned at right angles by the engine suction to discharge through hole 30. Prior to discharge, the air will impact directly into the fuel spray essentially at right angles to it to atomize the fuel.

It will be clear that the gear drive 62 can be secured directly to the conventional vehicle accelerator pedal controlled by the operator or automatically controlled by electronic means so that as the pedal is depressed from the conventional idle speed position, the gear drive will move the sleeve valve 52 downwardly in a progressive proportionate manner to open the C-D area and increase the air flow therethrough in proportion to the increased fuel being injected at the higher speed level. At the same time, the pressure differential across the hole 30 will decrease until eventually at full open throttle, essentially no air flow will occur through slots 40.

From the foregoing, it will be seen that the invention provides fuel atomizing throttle body particularly adapted for use with a single point, centrally located type fuel injector that eliminates the conventional rotatable throttle valve to provide not only a controlled variable area air flow into the engine, but also a flow that impacts upon the fuel spray to atomize the fuel in a manner providing efficient operation of the engine.

While the invention has been shown and described in its preferred embodiment, it will be clear to those skilled in the arts to which it pertains that many changes and modifications may be made thereto without departing from the scope of the invention.

I claim:

1. A central fuel injection type fuel feed system for an automotive type internal combustion engine including an air/fuel throttle body having an air/fuel passage therethrough open at one end to air essentially at an atmospheric pressure level and adapted to be connected at its opposite end to the intake manifold of the engine to subject the passage to the varying vacuum levels therein, a fuel injector means concentrically positioned in the passage for discharge of fuel thereinto in a longitudinal direction with a conical-like spray pattern, and an axially movable sleeve type throttling valve for variably controlling the flow of air into the passage for mixture with the fuel sprayed therein, the valve and injector means together defining a variable area convergent-divergent air flow area between, the sleeve valve including a sleeve and annular air throttling means projecting radially inwardly of the sleeve and tapering progressively inwardly in an axial direction towards the intake manifold end of the throttle body, the fuel injection means including a cup-shaped member having an angled side wall portion cooperating with the throttling means to define the path varying in area as a function of the axial movement of the sleeve valve, the cup-shaped member including a plurality of circumferentially spaced air swirl slots directing the air radially inwardly towards the fuel injector means for mixture of the air with fuel discharged from the injector means for atomization thereof, the sleeve being formed with a second annular diffuser-like means contiguous to and downstream of the first mentioned ramplike means and diverging radially outwardly in an axial direction towards the intake manifold end of the passage, the junction between the ramp and diffuser-like means constituting a step providing a large pressure differential to the air flowing between the two.

* * * * *